United States Patent [19]

Carter

[11] Patent Number: 4,863,003

[45] Date of Patent: Sep. 5, 1989

[54] COMBINATION SEAT CUSHION TOTE BAG

[76] Inventor: Alice L. Carter, 1217 Phoenix, No. 5, Fort Smith, Ark. 72901

[21] Appl. No.: 207,950

[22] Filed: Jun. 17, 1988

[51] Int. Cl.[4] ..... A45C 9/00; A45C 13/10

[52] U.S. Cl. ..... 190/8; 190/1; 383/4; 5/420; 5/462; 5/466; 297/118; 297/188; 297/217

[58] Field of Search ..... 190/1, 2, 8, 9; 383/4, 383/3; 5/417, 420, 462, 466; 297/129, 217, 188, 118; 150/6

[56] References Cited

U.S. PATENT DOCUMENTS

| | | | |
|---|---|---|---|
| 954,840 | 4/1910 | Wiedemann | 383/4 X |
| 2,270,598 | 1/1942 | Morgan | 383/4 X |
| 2,865,433 | 12/1958 | Warner | 190/8 X |
| 3,041,638 | 7/1962 | Lovico | 383/4 X |
| 3,052,895 | 9/1962 | Lovico | 383/4 X |
| 3,143,748 | 8/1964 | Manning | 190/2 X |
| 3,763,972 | 10/1973 | Karzmar | 190/8 |
| 4,190,918 | 3/1980 | Harvell | 190/8 X |
| 4,243,340 | 1/1981 | MacGregor | 190/109 X |
| 4,535,878 | 8/1985 | Grahl | 190/8 X |
| 4,566,130 | 1/1986 | Coates | 190/1 X |

FOREIGN PATENT DOCUMENTS

| | | | |
|---|---|---|---|
| 2047548 | 4/1971 | Fed. Rep. of Germany | 383/4 |
| 2478972 | 10/1981 | France | 190/1 |

*Primary Examiner*—Sue A. Weaver
*Attorney, Agent, or Firm*—Head & Johnson

[57] ABSTRACT

A combination seat cushion and tote bag comprising a seating portion and at least one side portion having a pocket enclosure secured to its upper surface and including means for releasably securing the side portion in an overlapped relationship with the seating portion and further including a handle means.

4 Claims, 2 Drawing Sheets

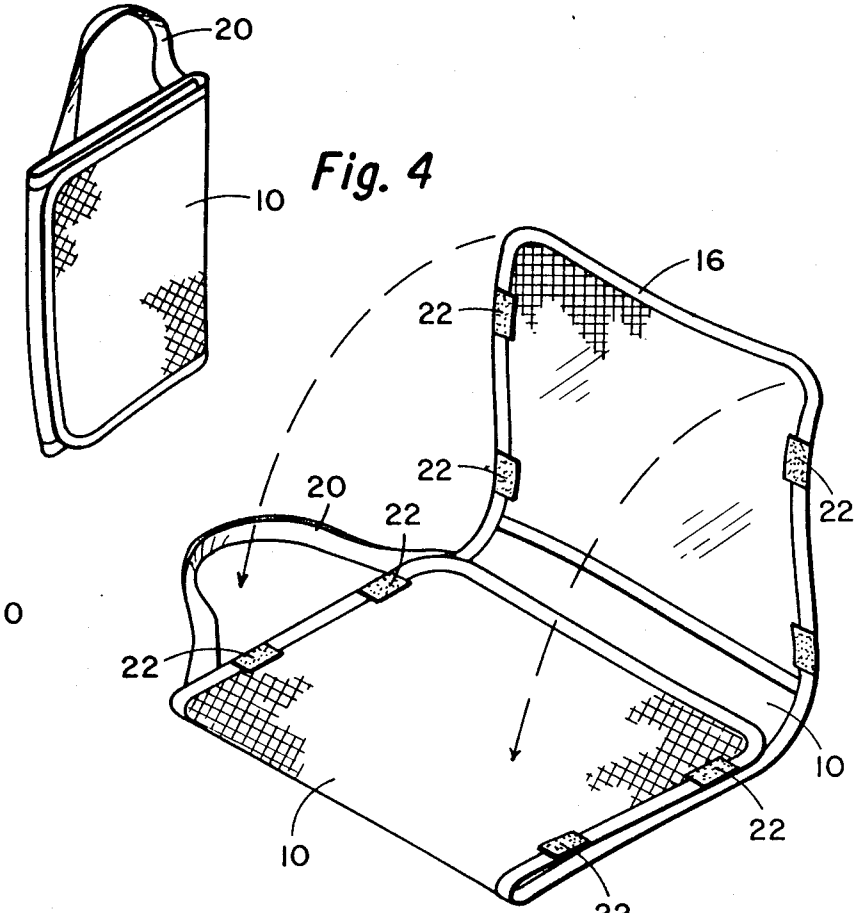
Fig. 3
Fig. 4
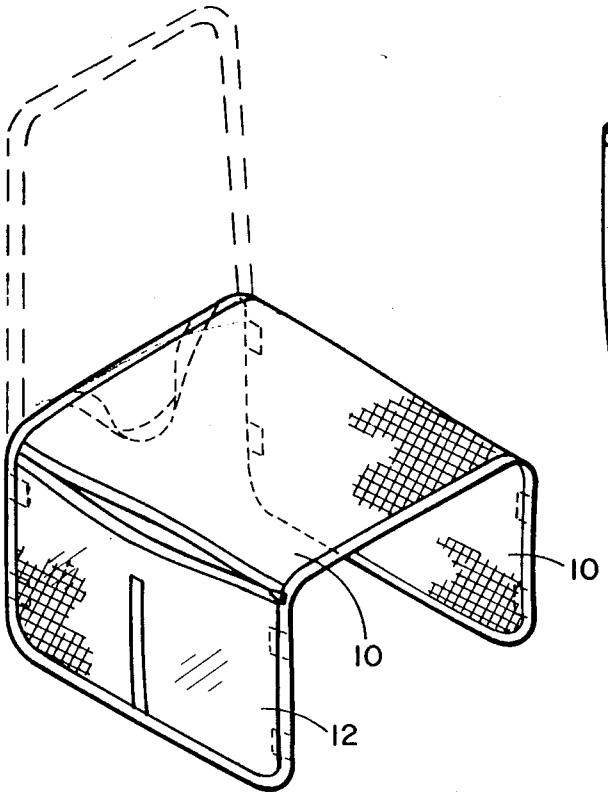
Fig. 2

COMBINATION SEAT CUSHION TOTE BAG

FIELD OF THE INVENTION

The present invention relates to a tote bag, particularly to a tote bag that is useful for carrying various types of paraphernalia that people often desire to carry at Bingo games, spectator sporting events, and the like. In another aspect, this invention relates to a device that is suitable for covering the seating surface of a chair, bench, or the like.

BACKGROUND OF THE INVENTION

Persons attending Bingo games, auctions, football games, horse races, and the like, often find that the seating provided at the functions is less than desirable. Many times the chairs or benches provided are of rough wood or cold, slippery metal. The rough wood surfaces can sometimes result in splinters which can inflict distracting discomfort. There is thus often the need to have something which will cushion the seating provided at such functions. It is also common for persons attending such functions to desire to carry with them various type of paraphernalia that is associated with the particular event. Examples of such paraphernalia include racing forms, Bingo dobbers, writing instruments, notepads, address books, programs, pocketbooks, and the like. An object of the present invention is to provide a device which will serve both as a tote bag and a seat cover so as to enable one to keep assorted paraphernalia in one place and at the same time have something which will allow for more comfortable seating.

SUMMARY OF THE INVENTION

In accordance with the present invention, there is provided a combination seat cushion, tote bag. The device includes (1) a seating portion comprising a sheet of material having upper and lower surfaces and (2) at least one side portion comprising material having upper and lower surfaces, said material extending from the seating portion. At least one of the side portions has a pocket enclosure secured to its upper surface. The device further includes means to releasably secure each of said side portions in an overlapped relationship with the seat portion. Still further, there is provided a handle means secured to the bag, preferably along or proximate to an edge of said seating portion or to an edge of one of said side portions.

BRIEF DESCRIPTION OF THE DRAWINGS

FIG. 2 is a perspective view of the bag of the preferred embodiment of FIG. 1 in place on a chair, shown with phantom lines.

FIG. 3 is a perspective view illustrating how the side portions can be folded over the seating portion.

FIG. 4 is a perspective view of the bag in its closed position.

DETAILED DESCRIPTION OF THE DRAWINGS

Figure 1:
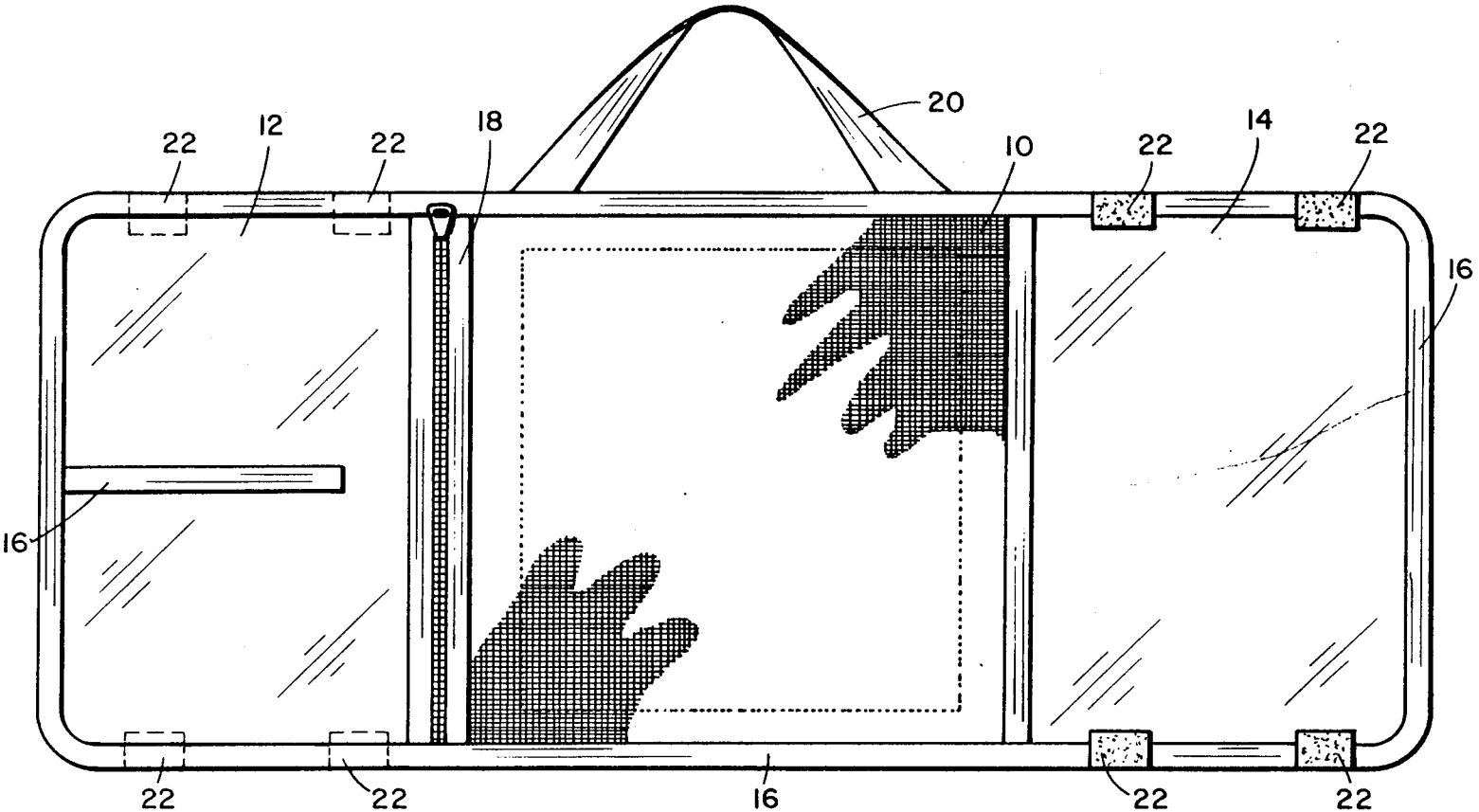
FIG. 1 is a top perspective view of a preferred embodiment of the present invention with both side portions of the device open so that the device is laying out flat.

The seating portion and the side portion of the present inventive device can be constructed of any suitable material. Currently preferred materials include fabric of natural or synthetic fibers. Typically, a double-faced fabric is preferred. Non-allergenic, washable fabrics are most preferred. The combination of the seating portion and the side portion or portions could be formed from a single, unitary sheet of material or could be of different materials secured together in some suitable fashion.

The actual dimensions of the seating portion and each side portion can be of any suitable size. While either of the side portions can be of a width different than that of the seating portion or of that of the opposite side portion, it is currently preferred that the inventive device be constructed of a single sheet of generally rectangular, flexible material. Typically, the seating portion would have a width in the range of about 14 to 18 inches and a length of about 15 to 20 inches. Each side portion preferably has a width corresponding to the width of the seating portion and a length no greater than that of the length of the seating portion. Preferably the length of each side portion is in the range of about 8 to about 15 inches, more preferably about 10 to about 12 inches. The pocket enclosure could take any suitable form, preferably each pocket enclosure is a generally rectangular sheet of flexible material closed on three sides and open on one side. Generally the open side would be positioned adjacent the seating portion or adjacent the top edge of the side portion. The phrase top edge of the side portion refers to the edge that is at the top when the device is held by handle secured to a free edge of the seating portion.

The particular material employed to construct the pocket enclosure is not critical. It is, however, currently preferred to employ a sheet of clear, flexible plastic, such as polyethylene, polypropylene, or polyvinylchloride. It is also desirable in some embodiments to have one or more internal seam within said pocket in order to provide a plurality of divided compartments within said pocket.

Preferably the handle portion is attached to a free edge of the seating portion. The term "free edge" as used herein refers to an edge not in contact with a side portion. The handle can take any suitable form. In a particularly preferred embodiment, the handle comprises a strip of fabric, preferably elasticized, the opposite ends of which are secured to opposite ends of a free edge of the seating portion.

It should also be noted that it is within the scope of the present invention to secure the handle to the free edge of a side portion or to some point within the edges of the seating and side portions. It is thus also within the scope of the invention to have separate handle means located on the edges of different portions of the bag so that when the side portion or portions are overlapped with the seating portion, the two handle portions can be gripped together.

The means for releasably securing each said side portion in an overlapped relationship with the seating portion can be constructed of any suitable material. Examples include snaps, zippers, hook and eyes, and barb-and-hook fabric fasteners of the type generally sold as Velcro® fasteners.

A further understanding of the invention and its advantages will be provided by referring to the specific embodiment illustrated in the FIGS. 1–4.

The preferred embodiment illustrated in FIG. 1 comprises a generally rectangular sheet of double-faced fabric 10. The fabric is about 40 inches in length and about 16 inches in width. The other components employed in making the bag illustrated in FIG. 1 include:

One generally rectangular plastic sheet 12 about 11 inches in length and 16 inches in width; a second generally flexible clear rectangular plastic sheet 14 about 12 inches in length and 16 inches in width; four yards of fabric strip binding 16; a sixteen inch long zipper 18; an 18 inch length of elastic fabric belting 20; four 1-inch squares of Velcro ® fastening material 22 and a sheet of cotton batting about ¼ to ½ inch thick. The cotton batting is placed between two layers of the double faced fabric and sewn into the central seating area. The sheets of flexible plastic are sewn to the three free edges of the respective side portions so as to provide an envelope pocket with an opening between the flexible plastic sheet and the double-faced fabric. The left side pocket has the clear plastic sheet secured to one side of the zipper 18. The other side of the zipper 18 is in turn secured to the double-faced fabric 10. This zipper could be of a mechanical, metallic or plastic type material. It could also be the groove and snap type zipper sometimes referred to as a "zip-lok" zipper. The handle is formed by sewing ends of the length of elastic belting 20 to a free edge of the seating portion of the double-faced fabric. Note that the secured ends of the elastic belting are attached at points proximate to opposed side portions of the bag. After the plastic sheets and the handle 20 have been sewn in place, then then strip of binding material 16 can be sewn around all the free edges of the double-faced fabric to provide additional reinforcement.

The bag then also has Velcro ® type fastener squares 22 secured along portions of the belting along the edge of the bag. On one side the Velcro ® patches are located on the bottom side of the bag and on the other side the Velcro ® patches are located on the upper surface of the bag so that when the two side portions are overlapped with the seating portion, the Velcro ® patches of the two opposed sides will interlock to provide a releasable securing of the two side portions. This is best illustrated in FIG. 3.

In a preferred embodiment the double-faced fabric material could include padding material especially in the area of the seating portion. The padded seating portion could, for example, be quilted, or include stitching to provide pleated areas. The padding could be provided of any suitable material. Examples would include: down, cotton fibers, cotton batting, and polymeric foam, either as solid sheet or as shredded form. In a preferred embodiment the seating area is totally covered with padding about ⅛ to about ½ inch thick.

It will be noted that in the plastic pocket on the left side portion of the illustrated bag, a length of binding material 16 is stiched part-way along the length of the pocket to divide the pocket into a plurality of chambers. The stitching secures the pocket to the underlying fabric portion of the side portion.

While the invention has now been described both in broad terms and in regard to a particular preferred embodiment, it should be apparent that there are many modifications and variations of the present invention which are possible in light of the above teachings. It is therefore to be understood that many modifications and variations can be made without departing from the spirit and scope of the present invention.

What is claimed:

1. A combination seat cushion, tote bag comprising, (a) seating portion comprising a generally rectangular sheet of double faced fabric having dimensions in the range of about 15 to about 20 inches by about 14 to about 18 inches, including a padded area;

(b) right and left side portions comprising generally rectangular sheets of double faced fabric extending from opposite sides of the seating portion, said right and left portions having dimensions such that at least a portion thereof is capable of overlapping the opposite side portion when both said side portions are folded over the same side of said seating portion;

(c) a pocket enclosure secured to the upper surface of each of said side portions, said pocket enclosures each being generally rectangular sheets of clear, flexible plastic having three sides secured to the adjacent free edges of the respective side portions and a fourth side unsecured to the respective side portion to provide an opening into said pocket enclosure; wherein at least one of said pocket enclosures is divided into at least two compartments, both of which is accessible via the opening in said pocket enclosure, said pocket enclosure that has at least two compartments having associated therewith a zipper, one side of which is secured to the free edge of said pocket enclosure and the other side of which is secured to the upper surface of the respective side portion;

(d) means for releasably securing said side portions to each other in an overlapped relationship with said seating portion, said means for releasably securing said side portions including hook and loop fabric fastener material suitably located on the top surface of one of said side portions and on the bottom surface of the other of said side portions so as to cause said fastener material to overlap when said side portions are overlapped over said seating portions; and (e) a handle means comprising a strip of elasticized fabric belting, one end of which is secured to a free edge of said seating portion proximate to one side portion and the other end of which is secured to said same free edge of said seating portion proximate to the opposite side portion.

2. A bag according to claim 1 wherein fabric binding is sewn around the free edges of the double faced fabric cloth which makes up the seating portion and right and left side portions.

3. A combination seat cushion, tote bag comprising an elongated generally rectangular sheet of material having upper and lower surfaces, comprising a generally rectangular central portion and right and left side portions extending respectively from right and left sides of said central portion, said right and left side portions having dimensions such that when each is folded over the upper surface of said central portion, at least a portion of said side portions will be overlapping, wherein said central portion comprises padding, said right and left side portions have pocket enclosures secured to the upper surface thereof, said pocket enclosures each being generally rectangular sheets of clear flexible plastic having three sides secured to the adjacent three edges of the respective side portion and having adjacent the central portion an opening between the clear plastic sheet and the side portion, and further comprising strips of hook and loop fabric fastener material suitably located on the upper surface of one side portion and on the lower portion of the other side portion so that said strips on said side portions will overlap in a fastening manner when a first of said side portions is overlapped over said central portion and then the other of said side portions is folded over the first said side portion, and a handle means comprising a strip of material having two ends, one end of which is secured to a free edge of said central portion proximate to one said side portion and the other end of which is secured to the same free edge of said central portion proximate to the other said side portion.

4. A bag according to claim 3 wherein the elongated generally rectangular sheet has a width in the range of about 14 to 18 inches, the seating portion has a length in the range of about 15 to 20 inches, and the length of each side portion is in the range of about 8 to 15 inches.

* * * * *